US007832602B2

(12) United States Patent
Ho

(10) Patent No.: US 7,832,602 B2
(45) Date of Patent: Nov. 16, 2010

(54) CROWN SIZER FOR METAL HOOK HANGER

(75) Inventor: Leung Ho, Kowloon (HK)

(73) Assignee: The Build-Up Plastic & Metal Co., Ltd., Kowloon (HK)

( * ) Notice: Subject to any disclaimer, the term of this patent is extended or adjusted under 35 U.S.C. 154(b) by 0 days.

(21) Appl. No.: 12/268,210

(22) Filed: Nov. 10, 2008

(65) Prior Publication Data

US 2009/0120973 A1 May 14, 2009

Related U.S. Application Data

(60) Provisional application No. 60/986,457, filed on Nov. 8, 2007.

(51) Int. Cl.
*A41D 27/22* (2006.01)

(52) U.S. Cl. ..... 223/85; 40/322

(58) Field of Classification Search ..... 223/85, 223/88; 40/322; D6/328
See application file for complete search history.

(56) References Cited

U.S. PATENT DOCUMENTS

| | | | | |
|---|---|---|---|---|
| 4,123,864 | A | 11/1978 | Batts et al. | |
| 4,881,836 | A | 11/1989 | Blanchard | |
| 5,687,887 | A * | 11/1997 | Bond et al. | 223/85 |
| 7,240,813 | B1 | 7/2007 | Goldman | |
| D552,361 | S | 10/2007 | Goldman | |
| 7,303,101 | B2 | 12/2007 | Goldman | |
| 7,464,841 | B1 * | 12/2008 | Hansen et al. | 223/85 |
| 7,513,400 | B2 * | 4/2009 | Gouldson | 223/85 |
| 7,516,875 | B2 * | 4/2009 | Gouldson | 223/85 |
| 2006/0006204 | A1 | 1/2006 | Mainetti | |
| 2006/0213938 | A1 | 9/2006 | Gouldson | |
| 2007/0062984 | A1 * | 3/2007 | Louw | 223/85 |
| 2007/0175932 | A1 | 8/2007 | Wu | |
| 2007/0199963 | A1 * | 8/2007 | Gouldson | 223/85 |
| 2007/0272716 | A1 * | 11/2007 | Wu | 223/85 |
| 2008/0054029 | A1 | 3/2008 | Ho | |

FOREIGN PATENT DOCUMENTS

| | | |
|---|---|---|
| AU | 42320/78 B1 | 6/1979 |

* cited by examiner

*Primary Examiner*—Gary L Welch
*Assistant Examiner*—Nathan E Durham
(74) *Attorney, Agent, or Firm*—Hoffmann & Baron, LLP

(57) ABSTRACT

A crown sizer for a metal hook hanger. The hanger includes a hook-receiving post having a pair of opposing projections extending outwardly therefrom. The sizer is mounted about the post, and includes a body formed of first and second pairs of opposing sidewalls. Each of the opposing sidewalls in the first pair includes an engagement shoulder on the interior surface thereof, the shoulders being located and sized to engage the projections thereby securing the sizer about the post.

13 Claims, 3 Drawing Sheets

CROWN SIZER FOR METAL HOOK HANGER

This application claims the benefit of U.S. Provisional Application Ser. No. 60/986,457 filed Nov. 8, 2007, the disclosure of which is hereby incorporated by reference in its entirety.

BACKGROUND OF THE INVENTION

The present invention relates to crown sizers and, more particularly, to a crown sizer which engages the post of a metal hook hanger.

Various types of hangers are used in the retail industries. One such hanger is formed from a plastic body having a post on its upper edge. A metal hook is threaded into this post to provide what is commonly referred to as a metal hook hanger.

Although size indicators are commonly used with plastic hook hangers (i.e., a hanger having both a plastic body and a plastic hook), the use of size indicators on metal hook hangers has proven more challenging. One such size indicator available for metal hook hangers is referred to as a crown sizer. These crown sizers are configured to be positioned about and secured to the post of the hanger. Various prior art crown sizers are shown in U.S. Publication Nos. 2006/0006204 A1, 2006/0213938 A1 and 2007/0175932 A1.

Although the mentioned publications disclose a plurality of crown sizer designs, each of these designs suffers from one or more drawbacks. For example, many prior art crown sizers require (for engagement) a protrusion or other such projection extending from an interior side of the crown sizer body. Those skilled in the art will appreciate that this type of geometry increases both the cost and complexity of molding such pieces. It also increases the time and cost associated with any subsequent modifications which may be required in the mold. In addition, many of the prior art sizers engage the hanger in a "loose" and/or "sloppy" manner which allows the sizer to move with respect to the hanger, even after installation. This movement or "rattling" is undesirable in a retail setting. Moreover, this "loose" fit associated with many of the prior art sizers can facilitate unwanted/accidental removal of the sizer from the hanger. Other prior art sizers include inwardly-projecting tabs for engagement with the flange of the hanger, a design which typically requires greater installation effort and which can provide a surface for "prying" of the sizer off of the hanger. Finally, the more elaborate designs shown in the mentioned applications present manufacturing challenges, as well as issues with both the installation and retention of the sizer on the hanger.

There is therefore a need in the art for a crown sizer which can be manufactured with reduced cost and effort, which can be readily installed about the post of a metal hook hanger without undue force or effort, which will "hug" the post to limit "rattling", and which will resist unwanted/accidental removal of the sizer from the hanger.

SUMMARY OF THE INVENTION

The present invention, which addresses the needs of the prior art, relates to a hanger/sizer combination. The hanger includes a hanger body defining a flange having a length and a width. The hanger further includes a hook-receiving post extending from the flange. The post includes a pair of opposing projections extending outwardly therefrom in a direction generally perpendicular to the length of the flange. The combination further includes a sizer mounted about the post. The sizer includes a body formed of first and second pairs of opposing sidewalls. Each of the sidewalls in the first pair has a length L extending in a direction generally parallel to the length of the flange and each of the sidewalls in the second pair has a width W extending in a direction generally parallel to the width of the flange. The length L is greater than the width W. Finally, each of the opposing sidewalls in the first pair includes an engagement shoulder on the interior surface thereof, the shoulders being located in size to engage the projections thereby securing the sizer about the post.

In one preferred embodiment, each of the sidewalls in the first pair includes a notch extending from the rim, the notch having a reduced wall thickness and defining the engagement shoulder. In another preferred embodiment, the diameter of the post at the hook-receiving end is sized to engage the sidewalls of the first pair. In another preferred embodiment, the diameter of the post at the hook-receiving end is sized to flex the sidewalls of the first pair in a direction extending away from the post thereby bowing the sidewalls of the first pair to provide increased contact engagement between the projections and the shoulders. In still another preferred embodiment, each of the projections includes a flattened face portion to increase the contact area with the shoulders.

As a result, the present invention provides a hanger/sizer combination in which the sizer can be manufactured with reduced cost and effort, can be readily installed about the post of a metal hook hanger without undue force or effect, will "hug" the post to limit "rattling", and will resist unwanted/accidental removal of the sizer from the hanger.

DETAILED DESCRIPTION OF THE INVENTION

Figure 1:
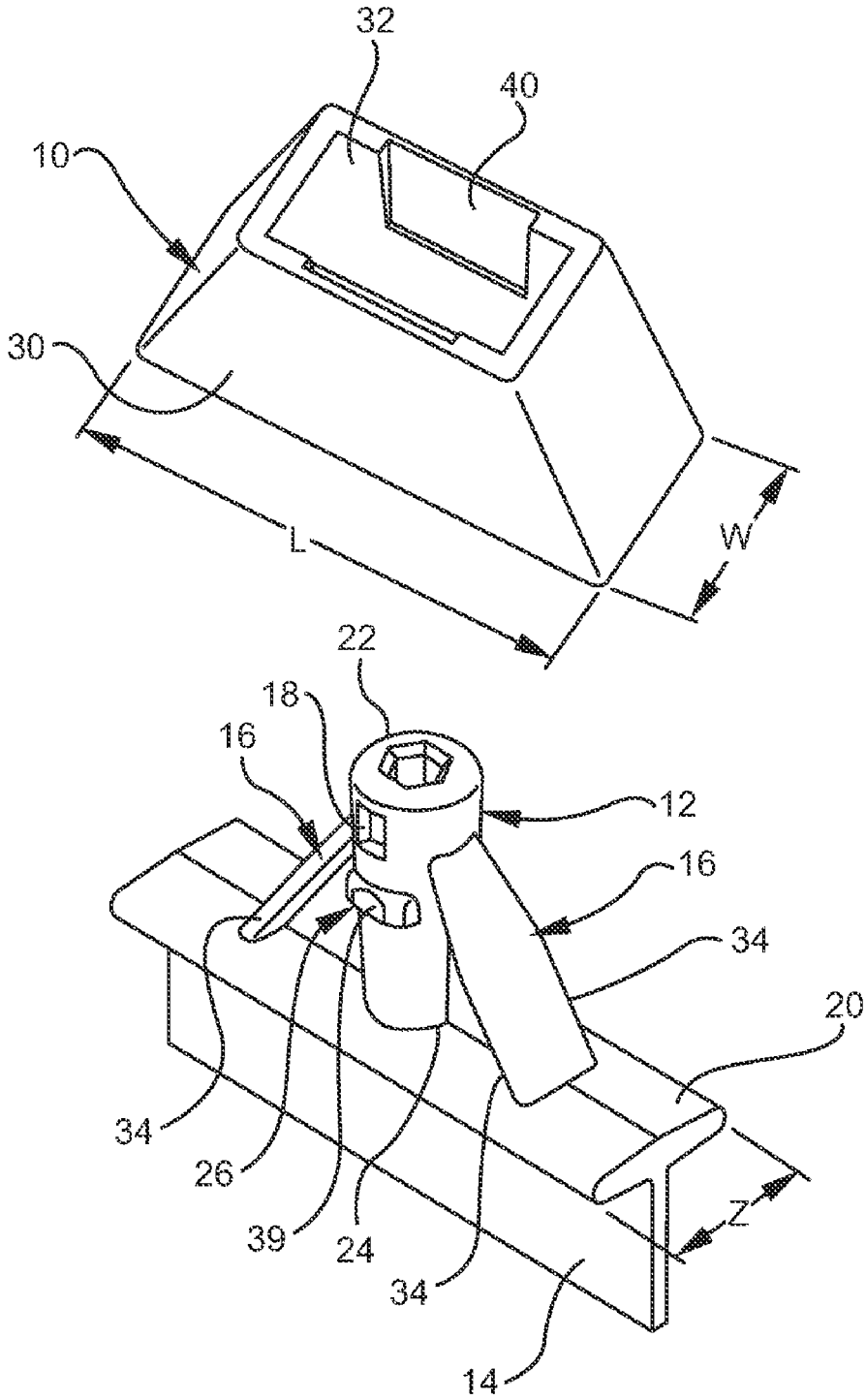
FIG. 1 is a perspective view showing a sizer formed in accordance with the present invention exploded away from the upper portion of a hanger formed in accordance with the present invention.
Figure 2:
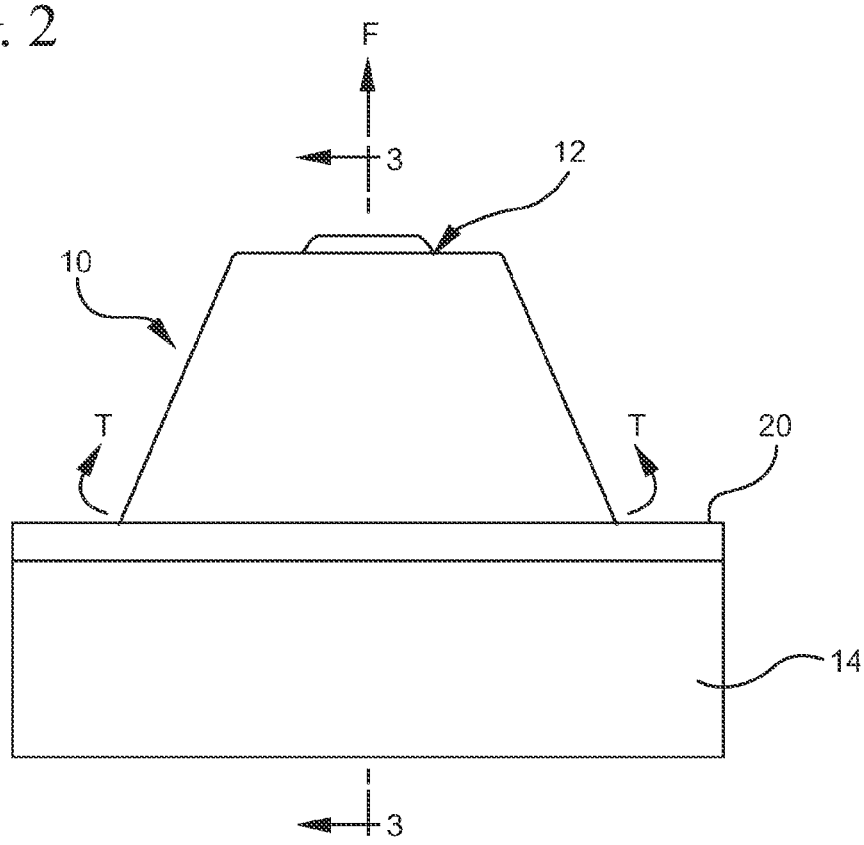
FIG. 2 is an elevation view showing the sizer of the present invention installed on the hanger of FIG. 1.

Referring to FIGS. 1 to 6, a crown sizer 10 of the present invention is sized and configured to mount about a post 12 of a metal hook hanger. Post 12 may be integrally formed with a body 14 of the hanger, and may include opposing struts 16. Post 12 may also include a pair of opposing recesses 18. In one preferred embodiment, post 12 increases in diameter in a direction extending away from flange 20 of body 14, i.e., the diameter of distal end 22 is greater than the diameter of proximal end 24. As explained further hereinbelow, distal end 22 preferably contacts at least a portion of sizer 10.

A pair of opposing and outwardly-protruding projections, e.g., lips 26, are preferably provided on post 12. These lips are sized and located to cooperate with a pair of opposing shoulders 28 (best seen in FIGS. 5 and 6) provided on the interior of sidewalls 30, 32. The location of the lips on the post eliminates the need to mold protrusions on the interior side of the sizer, thereby facilitating the molding operation. In addition, by locating the lips on the post, the lips are thereby positioned in the substantial center of sidewalls 30, 32. Such an arrangement facilitates installation because the center portion of sidewalls 30, 32 can be flexed more readily and to a greater degree (as the sizer passes over the post) than other portions of the sizer.

In one preferred embodiment, the locking interaction between lips 26 and shoulders 28 urges the bottom of the sizer into contact with flange 20, thereby reducing "rattling" of the sizer on the hanger. The locking interaction between lips 26 and shoulders 28 also makes removal of the sizer from the hanger more difficult. In particular, the locking interaction will resist (in a substantially opposite direction) a removal force F applied to the sizer, as well as a twisting force T applied between the bottom of the sizer and flange 20 (see FIG. 2).

In one preferred embodiment, the overall width W at the bottom of sizer 10 is selected to substantially correspond to width Z of flange 20, thereby making it more difficult to "pry" the sizer off of the hanger while at the same time improving the overall aesthetics of the sizer/hanger combination. Sidewalls 30, 32 are preferably formed with a length L, wherein length L is preferably greater than width W. In addition, the interior walls of the sizer are preferably formed to substantially conform to and/or engage lower edges 34 of struts 16, which further reduces "rattling" and resists rotation of the sizer about an axis Y extending through the post.

Figure 3:
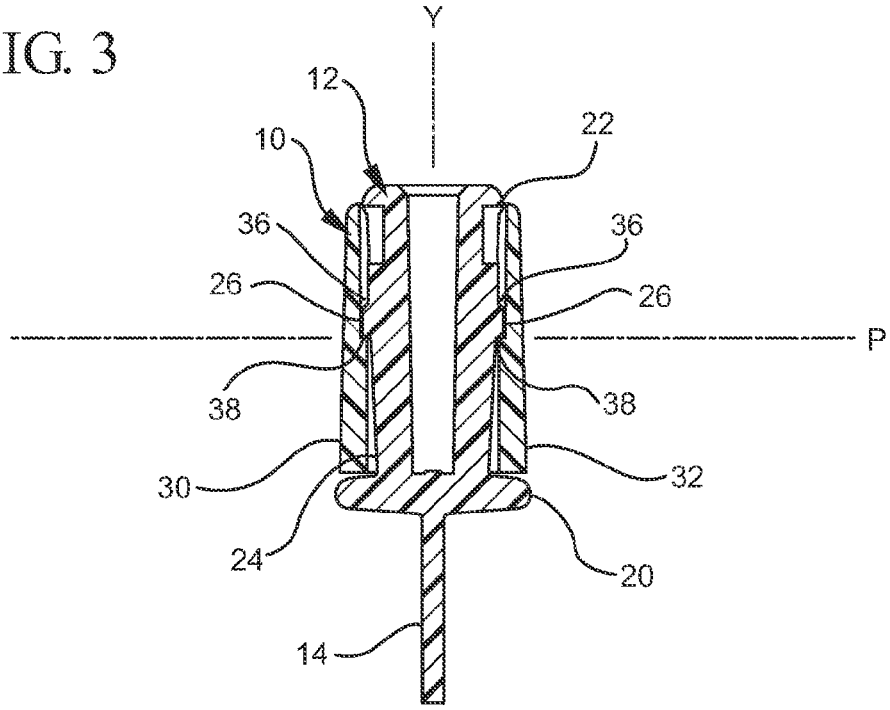
FIG. 3 is a cross-section taken along lines 3-3 of FIG. 2.
Figure 4:
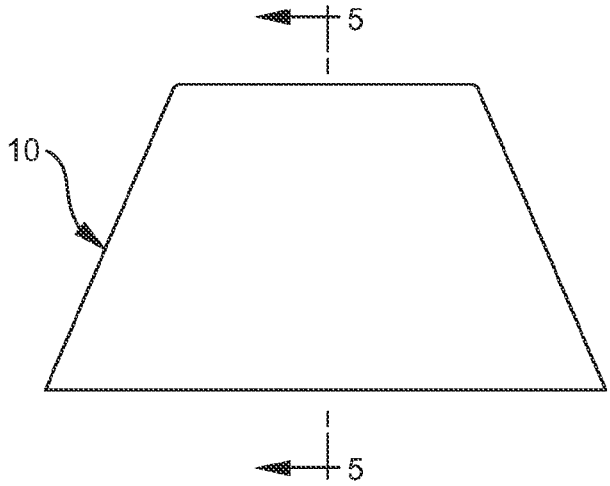
FIG. 4 is an elevation view of the sizer of the present invention.
Figure 5:
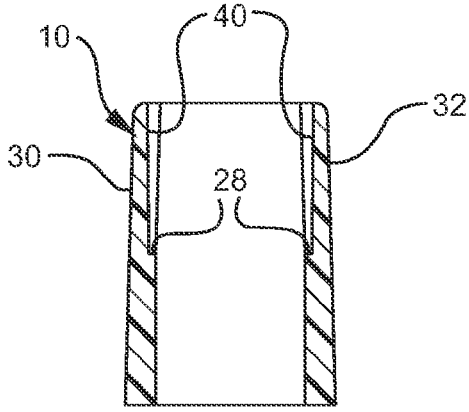
FIG. 5 is a cross-section taken along lines 5-5 of FIG. 4.

In practice, sizer 10 is positioned over post 12, and thereafter pushed downward about such post, whereby sidewalls 30, 32 flex slightly outward to allow shoulders 28 to travel past lips 26. The upper portions 36 of lips 26 are preferably angled/beveled to facilitate installation. Once positioned, sidewalls 30, 32 of sizer 10 return to their unflexed state whereby shoulders 28 engage lower edges 38 of lips 26 thereby securing sizer 10 about post 12. In one preferred embodiment, each of lips 26 includes a flattened face portion 39 which increases the area of contact between lower edges 38 and shoulders 28. As best seen in FIG. 3, lower edges 38 are preferably formed substantially perpendicular to the front face of the lips so that they engage shoulders 28 along a plane P which extends substantially perpendicular to axis Y.

Thus, the sizer of the present invention can be more readily installed over the post than prior art sizers which include multiple protrusions positioned to engage the regions located between the post and the adjacent struts. In other words, these prior art sizers require greater installation forces because the mentioned protrusions are located on portions of the sidewalls which are inherently more difficult to flex. Moreover, the configuration and size of such prior art protrusions often times result in a "loose" or "sloppy" fit of the sizer on the hanger.

Figure 6:
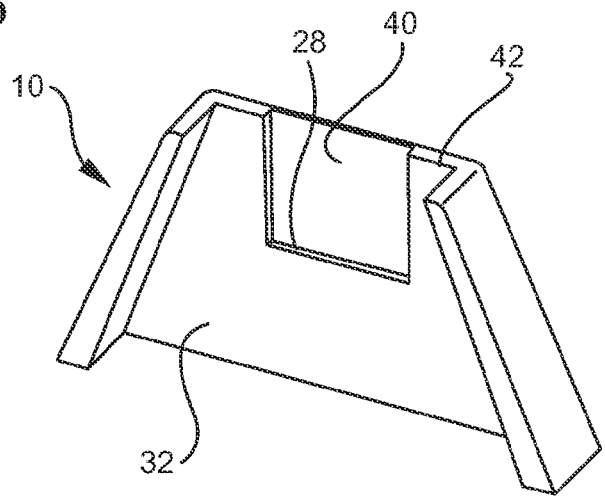
FIG. 6 is a sectional view of the sizer of FIG. 4.

Shoulders 28 of the present sizer are preferably formed by molding a notch 40 in each of sidewalls 30, 32. In one preferred embodiment, notch 40 is formed with a generally rectangular configuration wherein the wall thickness of the notch decreases in dimension in a direction extending from shoulder 28 to rim 42. It has been discovered herein that the use of a generally rectangular notch (as best seen in FIG. 6) to form shoulders 28 facilitates the molding operation associated with the manufacture of sizers 10, e.g., by eliminating the need for a slide cam and allowing for easier mold modification. In other embodiments, the wall thickness may vary along the length of the notch and/or the notch may be formed with other geometric configurations.

As best seen in FIG. 3, distal end 22 of the post (which has an increased diameter) contacts an upper portion (e.g., rim 42) of sidewalls 30, 32. This contact helps to further reduce "rattling" and, as discussed hereinbelow, can make removal of the sizer from the hanger more difficult. Of course, this arrangement can also be used to attach crown sizers without a rectangular notch to the post of a hanger.

In one preferred embodiment, distal end 22 contacts sidewalls 30, 32 within the area defined by the notch. The reduced wall thickness within the notch provides a degree of flexibility to such walls which i) facilitates installation of the sizer over the post, and/or ii) allows the walls to remain in resilient contact with the post for reduced "rattling". In addition, by reducing the wall thickness only within the area defined by the notch, the remainder of the sizer can be formed with walls having increased thickness which enhances the overall rigidity and strength of the sizer, and allows for better control of tolerances.

In another preferred embodiment, the resilient contact between post 12 and the upper portion of sidewalls 30, 32 is designed to urge such walls outward, which in turn tends to slightly "bow" the sizer, thereby urging shoulders 28 towards post 12. This "bowing" thus tends to increase the locking effect between the lips and the shoulders, while also making removal even more difficult because any effort to pry the sizer off the hanger tends to only increase this "bowing" (and thus the locking effect between the lips and the shoulders). Finally, the "bowing" of the sizer tends to further reduce "rattling" of the sizer on the hanger because it tends to encourage the shoulders and lips to remain in intimate contact with one another.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

The invention claimed is:

1. In combination:

a hanger, comprising:

a hanger body defining a flange having a length and a width; and a hook-receiving post extending from said flange, said post including a pair of opposing projections extending outwardly therefrom in a direction generally perpendicular to the length of said flange; and a sizer mounted about said post, comprising:

a body formed of first and second pairs of opposing sidewalls, each of said sidewalls in said first pair having a length L extending in a direction generally parallel to the length of said flange and each of said sidewalls in said second pair having a width W extending in a direction generally parallel to the width of said flange, said length L being greater than said width W; and wherein each of said opposing sidewalls in said first pair includes an engagement shoulder on the interior surface thereof, said shoulders located and sized to engage said projections thereby securing said sizer about said post, said sidewalls defining a rim and a bottom, each of said sidewalls in said first including a notch extending from said rim, said notch having a reduced wall thickness and defining said engagement shoulder, and wherein said engagement shoulder is defined within said notch.

2. The combination according to claim 1, wherein the wall thickness of said notch decreases in dimension in a direction extending from said shoulder to said rim.

3. The combination according to claim 2, wherein said notch is rectangular in shape.

4. The combination according to claim 3, wherein one end of said post defines a hook-receiving end, and wherein the diameter of said post at said hook-receiving end is greater than the diameter of said post at the end proximate said flange, and wherein the diameter of said post at said hook-receiving end is sized to engage said sidewalls of said first pair, and wherein said post engages said sidewalls of said first pair within said notch.

5. The combination according to claim 1, wherein one end of said post defines a hook-receiving end, and wherein the diameter of said post at said hook-receiving end is greater than the diameter of said post at the end proximate said flange.

6. The combination according to claim 5, wherein the diameter of said post at said hook-receiving end is sized to engage the interior surface of said sidewalls of said first pair.

7. The combination according to claim 6, wherein said sidewalls of said first pair are formed to resiliently engage said post.

8. The combination according to claim 7, wherein the diameter of said post at said hook-receiving end is sized to flex said sidewalls of said first pair in a direction extending away from said post thereby bowing said sidewalls of said first pair to provide increased contact engagement between said projections and said shoulders.

9. The combination according to claim 7, wherein the diameter of said post tapers from a first diameter D1 at said flange to a second diameter D2 at said hook-receiving end, and wherein diameter D2 is greater than diameter D1.

10. The combination according claim 1, wherein the width W of said second pair of sidewalls along said bottom is substantially equal to the width of said flange.

11. The combination according to claim 10, wherein said projections and shoulders are arranged to urge said bottom of said sizer against said flange to reduce rattling and hinder removal of said sizer.

12. The combination according to claim 1, wherein each of said projections includes a flattened face portion to increase the contact area with said shoulders.

13. The combination according to claim 1, wherein said hanger further comprises two opposing struts extending between said post and said flange, said struts being sized to engage the interior of said first pair of said sidewalls to reduce twisting of said sizer about said post.

* * * * *

UNITED STATES PATENT AND TRADEMARK OFFICE

CERTIFICATE OF CORRECTION

PATENT NO. : 7,832,602 B2
APPLICATION NO. : 12/268210
DATED : November 16, 2010
INVENTOR(S) : Leung Ho It is certified that error appears in the above-identified patent and that said Letters Patent is hereby corrected as shown below:

In Claim 1, line 23

Now reads: "said first including"
Should read: -- said first pair including --

Signed and Sealed this
Second Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,832,602 B2
APPLICATION NO. : 12/268210
DATED : November 16, 2010
INVENTOR(S) : Leung Ho It is certified that error appears in the above-identified patent and that said Letters Patent is hereby corrected as shown below:

Column 4, line 58 (Claim 1, line 23)

Now reads: "said first including"
Should read: -- said first pair including --

This certificate supersedes the Certificate of Correction issued August 2, 2011.

Signed and Sealed this
Twenty-third Day of August, 2011

David J. Kappos
*Director of the United States Patent and Trademark Office*